US006604961B2

(12) United States Patent
Ichioka

(10) Patent No.: US 6,604,961 B2
(45) **Date of Patent: *Aug. 12, 2003**

(54) SHIELD CONNECTOR FOR MINIMIZING ASSEMBLY ERROR WITH A CONNECTOR HOUSING

(75) Inventor: Tetsuo Ichioka, Nagoya (JP)

(73) Assignees: Harness System Technologies Research, Ltd., Mie (JP); Sumitomo Wiring Systems Ltd., Mie (JP); Sumitomo Electric Industries, Mie (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/522,001

(22) Filed: Mar. 9, 2000

(65) Prior Publication Data

US 2002/0002014 A1 Jan. 3, 2002

(30) Foreign Application Priority Data

Apr. 1, 1999 (JP) ..... 11-095375

(51) Int. Cl.[7] ..... H01R 13/648
(52) U.S. Cl. ..... 439/578

(58) Field of Search ..... 439/578

(56) References Cited

U.S. PATENT DOCUMENTS

| | | | | |
|---|---|---|---|---|
| 5,063,659 A | | 11/1991 | Wright | |
| 5,501,615 A | * | 3/1996 | Inaba et al. | 439/578 |
| 6,033,260 A | * | 3/2000 | Murata et al. | 439/578 |

FOREIGN PATENT DOCUMENTS

| | | |
|---|---|---|
| EP | 0 290 353 | 11/1988 |
| EP | 0 459 663 A1 | 12/1991 |
| WO | WO 93/10578 | 5/1993 |

* cited by examiner

*Primary Examiner*—Renee Luebke
(74) *Attorney, Agent, or Firm*—Oliff & Berridge, PLC

(57) ABSTRACT

A female connector is provided with a guide protrusion portion so as to cover a tip face of a female side shield shell, and when a male side shield shell is butted against an inclined face provided in the guide protrusion portion and pushed thereto, it proceeds toward an outer edge side of a tip face of the female side shield shell by being guided by the inclined face. Here, since the guide protrusion portion is provided in a female side connector housing of the female connector, a large guidable range can be ensured without being limited due to a wall thickness dimension of the shield shell.

2 Claims, 8 Drawing Sheets

SHIELD CONNECTOR FOR MINIMIZING ASSEMBLY ERROR WITH A CONNECTOR HOUSING

BACKGROUND OF THE INVENTION

1. Field of Invention

The present invention relates to a shield connector.

2. Description of Related Art

FIG. 6, illustrates one example of a conventional shield connector as the reference numeral 1. The shield connector 1 has a shield shell 3 (hereafter, referred to as "female side shield shell 3" for convenience) fitted around a terminal accommodation portion 2A provided in a connector housing 2, and if it is fitted to a mating connector housing 4, a mating shield shell 5 (hereafter, referred to as "male side shield shell 5" for convenience) is fitted to a tip outer side of the female side shield shell 3, so that both are electrically connected to each other as shown in FIG. 7. Further, as shown in FIG. 8 in enlarged scale, in an edge portion of a tip end face of the female side shield shell 3 taper face 3A is formed, and there is adopted such a constitution that even if both shield shells 3 and 5 are deviated, they are guided to a regular position by taper face 3A and taper face 5A formed in the male side shield shell 5.

In FIG. 8, the male side shield shell 5 at the regular position where axes of both shield shells 3 and 5 coincide with each other is shown by a solid line, and the male side shield shell 5 at a maximum deviation allowable position capable of guiding to the regular position is shown by a two-dot chain line.

Since the taper faces 3A and 5A can be formed over at most about a half of thickness t of the shield shells 3 and 5, in the conventional shield connector 1 a maximum deviation allowable amount L1 of both shield shells 3 and 5 has been able to ensure an extent of about the thickness dimension t when the taper face 5A is formed within a range of ½ of wall thickness t. Therefore, owing to a deviation in mutual fitting position of the connectors in some extent and an error in assembling the shield shell to the connector housing or the like, the end faces of the shield shells 3 and 5 butt against the mating side in a manner so as to render the fitting operation of the connector difficult.

SUMMARY OF THE INVENTION

The invention was made in view of the above circumstances, and its object is to provide a shield connector which permits improved fitting operation ability.

In order to achieve the above object, according to the invention, a shield connector is provided comprising: a connector housing having an engagement mechanism for engaging with a terminal metal fitting; a shield shell provided in the connector housing so as to surround the terminal metal fitting, the shield connector fitting with a mating connector housing to thereby cause a mating shield shell provided in the mating connector housing fit with a tip outer side of the shield shell, thereby making both into an electrically connected state; and a guide protrusion portion for guiding a tip of the mating shield shell so as to be fitted to the shield shell by extending to a side from an inner portion of the shield shell of the connector housing.

DETAILED DESCRIPTION OF PREFERRED EMBODIMENTS

First Embodiment

The first embodiment of the invention will be described referring to FIGS. 1 to 3.

Figure 1:
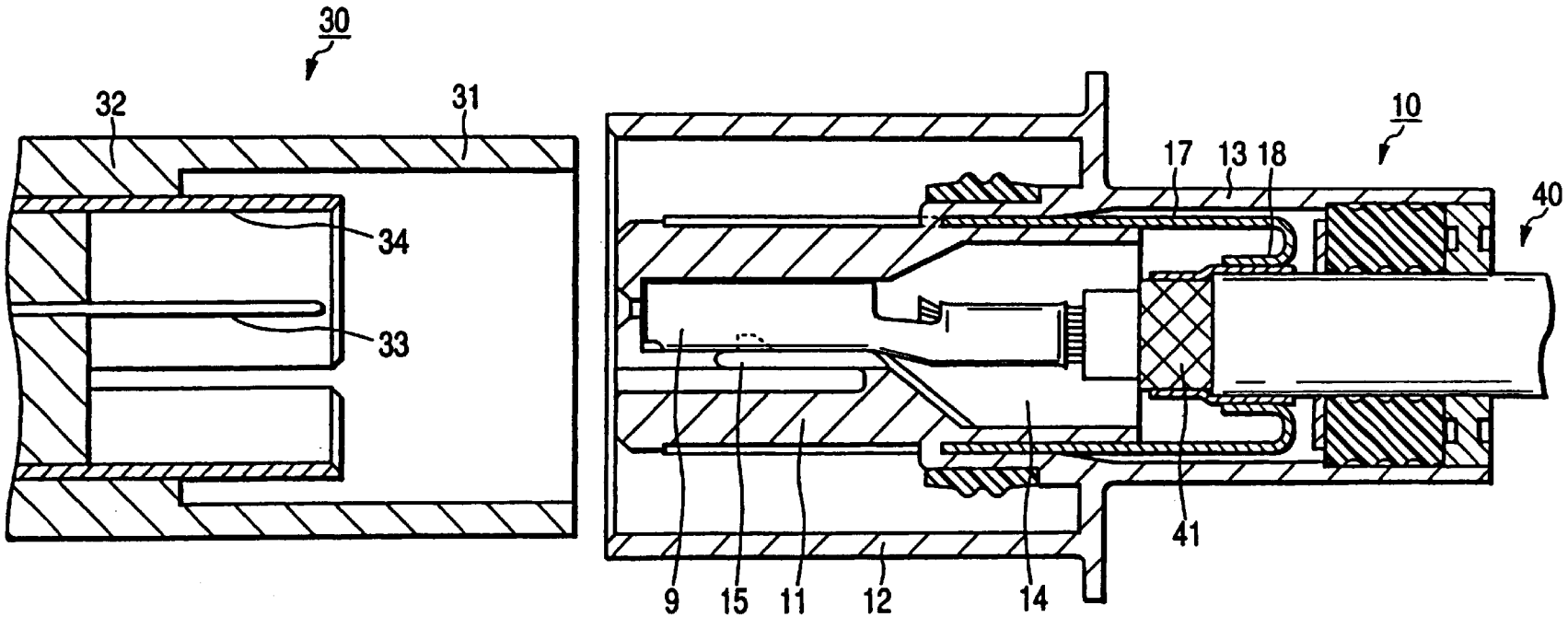
FIG. 1 is a side sectional view showing a state that both connectors of a first embodiment according to the invention are separated.
Figure 2:
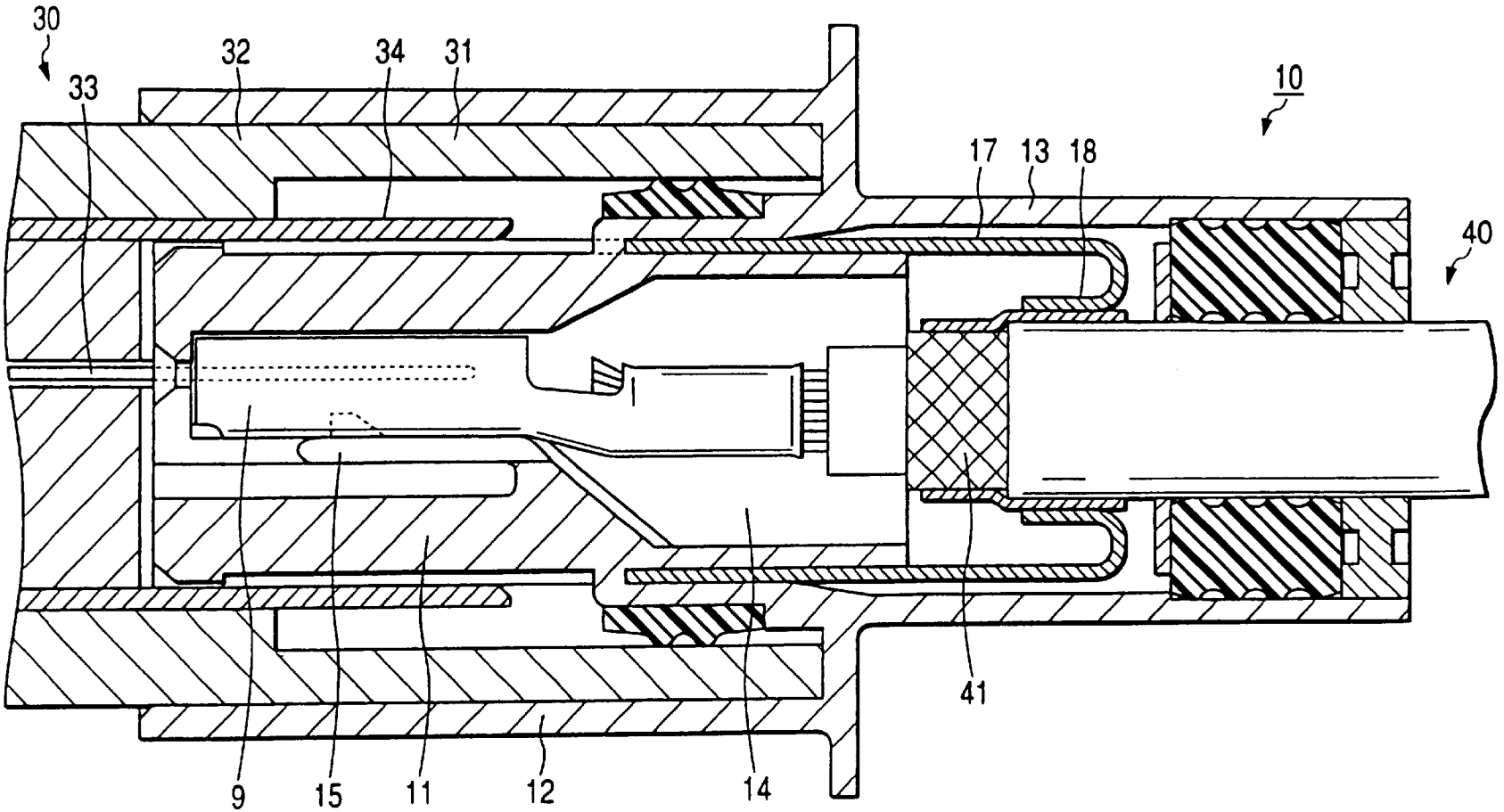
FIG. 2 is a side sectional view of both connectors of the same under a fitted state.

A shield connector of this embodiment is a female connector 10 shown at a right side of FIG. 1, and to this a mating male connector 30 at a left side is fitted.

First, the mating male connector 30 has a cavity inside a male side connector housing 32 having a cylindrical hood portion 31, and a tab 33 of male type terminal metal fitting accommodated in the cavity protrudes forward from an inner part of the hood portion 31. At a position surrounding the cavity, a cylindrical male side shield shell 34 is inserted into the male side connector housing 32 and mounted thereto. Further, as shown in FIG. 3, in the male side shield shell 34, there is formed a taper face 34B along an inner edge of its tip face 34A within a range of ½ of wall thickness t.

Female connector 10 to which the invention is applied has a female side connector housing 13 in which a cylindrical hood portion 12 is formed so as to surround a cylindrical portion 11, a cavity 14 is formed in the cylindrical portion 11 and a lance 15 corresponding to an engaging mechanism of the invention is integrally molded in the cavity 14. Further, a female type terminal metal fitting 9 accommodated in the cavity 14, is prevented from falling off and maintained by the lance 15.

On an outer surface of the cylindrical portion 11, a cylindrical female side shield shell 17 surrounding the female type metal fitting 9 is inserted into the female side connector housing 13 and mounted thereto. At a rear side of the female side shield shell 17, an elastic contact piece 18 is extended toward an inside, and the elastic contact piece 18 is conductively connected to a shield layer 41 of a shield wire 40 fixed to the female type terminal metal fitting 9. Further, as shown in FIG. 3, at a front side of the female side shield shell 17, a taper face 17B is formed along an outer edge of its tip face 17A within a range of ½ of the wall thickness t.

Figure 3:
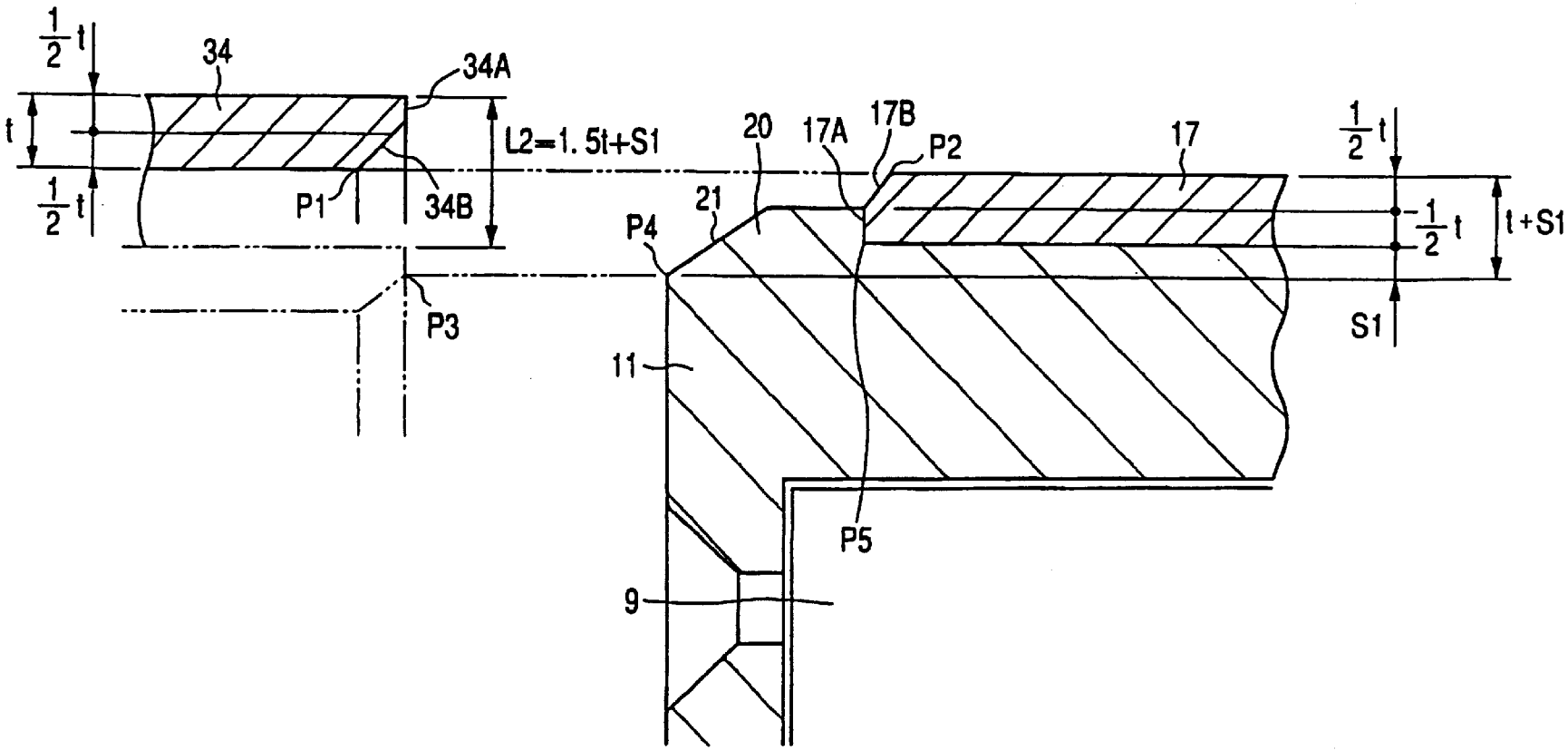
FIG. 3 is a side sectional view showing tip portions of shield shells provided in both connectors of the same.

Now, as shown in FIG. 3, at a tip portion of the cylindrical portion 11 of the female side connector housing 13, a guide protrusion portion 20 extending in flange-like form toward a side is provided. The guide protrusion portion 20 is set to a height covering an inner edge side of the tip face 17A of the female side shield shell 17. More detailedly, the guide protrusion portion 20 covers a lower side (lower half of the wall thickness t of the female side shield shell 17) than the taper face 17B of the tip face 17A of the female side shield shell 17.

At a front side of the guide protrusion portion 20, there is formed an inclined face 21 inclining so as to proceed to an outside of the female side shield shell 17 as going toward an inner part of the fitting. An inner edge (refer to a mark P4 in FIG. 3) of the inclined face 21 is positioned inside by a dimension S1 from an inner edge (refer to a mark P5 in FIG. 3) of the female side shield shell 17.

Next, a result of this embodiment will be explained. From a separated state shown in FIG. 1, both connectors 10 and 30 are mutually fitted. Then, as shown in FIG. 2, the hood portion 31 of the male side connector housing 32 enters into the hood portion 12 of the female side connector housing 13 and becomes fitted, and the tab 33 of the male type terminal metal fitting is fitted into the female type terminal metal fitting 16 and connected thereto. Further, simultaneously with this, a tip of the male side shield shell 34 is fitted with a tip outer side of the female side shield shell 17, and both are electrically connected to each other.

In some instances the connectors are mutually pushed under a state that a fitting position between the connectors deviates somewhat or that an assembling error of the shield shell with respect to the connector housing occurs. When the above deviation of the fitting position or the assembling error is large, the male side shield shell 34 butts against the inclined face 21 provided in the guide protrusion portion 20 of the female connector 10. If the connectors 10 and 30 are pushed under this state, the male side shield shell 34 proceeds toward an outer edge side of the tip face 17A of the female side shield shell 17 while being guided by the inclined face 21. Further, the male side shield shell 34 is guided by the taper face 17B provided in an outer edge portion of the female side shield shell 17 and reaches a regular position where axes of both shield shells 17 and 34 coincide with each other, so that they are pushed as they are to be mutually fitted and thus electrically connected to each other.

Here, since the guide protrusion portion 20 is provided in the female side connector housing 13 of the female connector 10, a large guidable range can be ensured without undergoing a limitation owing to a wall thickness dimension of the shield shell like in the conventional connector. More concretely, in the regular position where the axes of both shield shells 17 and 34 coincide with each other, an inner edge (referred to as mark P1 in FIG. 3) of the taper face 34B provided in the male side shield shell 34 and an outer edge (refer to a mark P2 in FIG. 3) of the taper face 17B provided in the female side shield shell 17 coincide with each other in a radial direction (vertical direction in FIG. 3) of the shield shell as shown by the solid line in FIG. 3. On the other hand, in the maximum deviation allowable position, as shown in FIG. 3 by the two-dot chain line, since an outer edge (referred to as mark P3 in FIG. 3) of the taper face 34B provided in the male side shield shell 34 and an inner edge (referred to as mark P4 in FIG. 3) of the inclined face 21 of the guide protrusion portion 20 coincide with each other in the radial direction of the shield shell, a maximum allowable deviation amount L2 of the shield shell in this embodiment becomes 1.5t+S1. Here, the maximum allowable deviation amount L2 is provided when the taper face 34B is formed within the range of ½ of wall thickness t. Further, by a change of the dimension S1, it is possible to set the maximum allowable deviation amount L2 of the shield shell large irrespective of the wall thickness t of the shield shell. Accordingly, even if the connectors mutually deviate in some extent or even if the assembling position of the shield shell scatters with respect to the connector housing, it follows that an end face of the shield shell does not butt against the mating side, so that a fitting operation can be easily performed.

Second Embodiment

Figure 4:
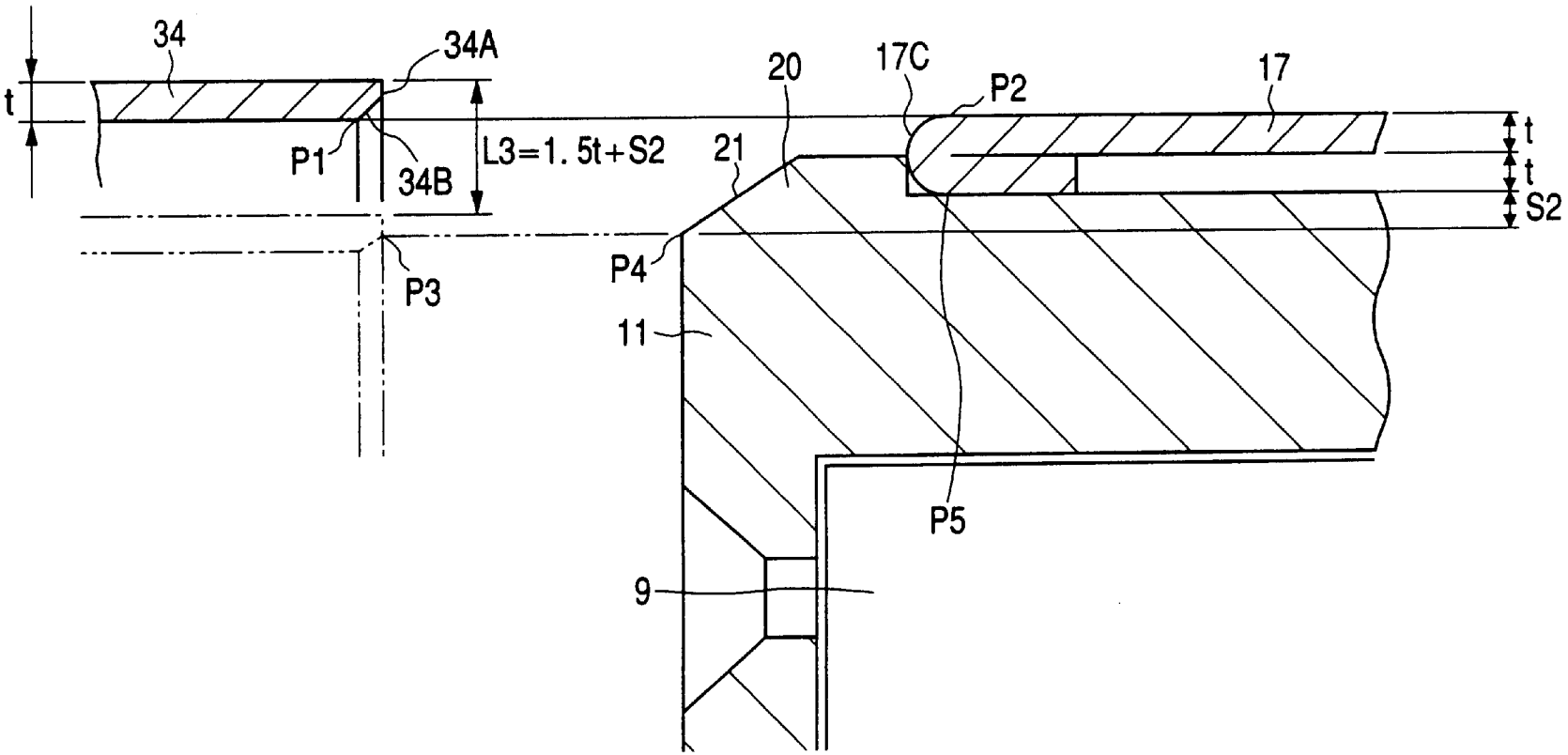
FIG. 4 is a side sectional view showing tip portions of both shield shells of a second embodiment.

As shown in FIG. 4, as to this embodiment, the same structural parts as those in the first embodiment are affixed with the same reference numerals and duplicated explanations are omitted so that only a different constitution will be explained below.

A tip of the female side shield shell 17 of this embodiment is doubled by being folded to an inner peripheral side, and the portion folded to the inner side is covered by the guide protrusion portion 20. By this, at an outer side of the guide protrusion portion 20 of the female side shield shell 17, a ¼ arc guide curved surface 17C for guiding the male side shield shell 34 to the regular position is formed.

If such a constitution is adopted, a maximum allowable deviation amount L3 of the male side shield shell 34 becomes 2.5t+S2 as shown in the drawing, and also by a change of the dimension S2 it is possible to set the maximum allowable deviation amount irrespective of the wall thickness t of the shield shell. Here, the maximum allowable deviation amount L3 is provided when the taper face 34B is formed within the range of ½ of wall thickness t.

Third Embodiment

Figure 5:
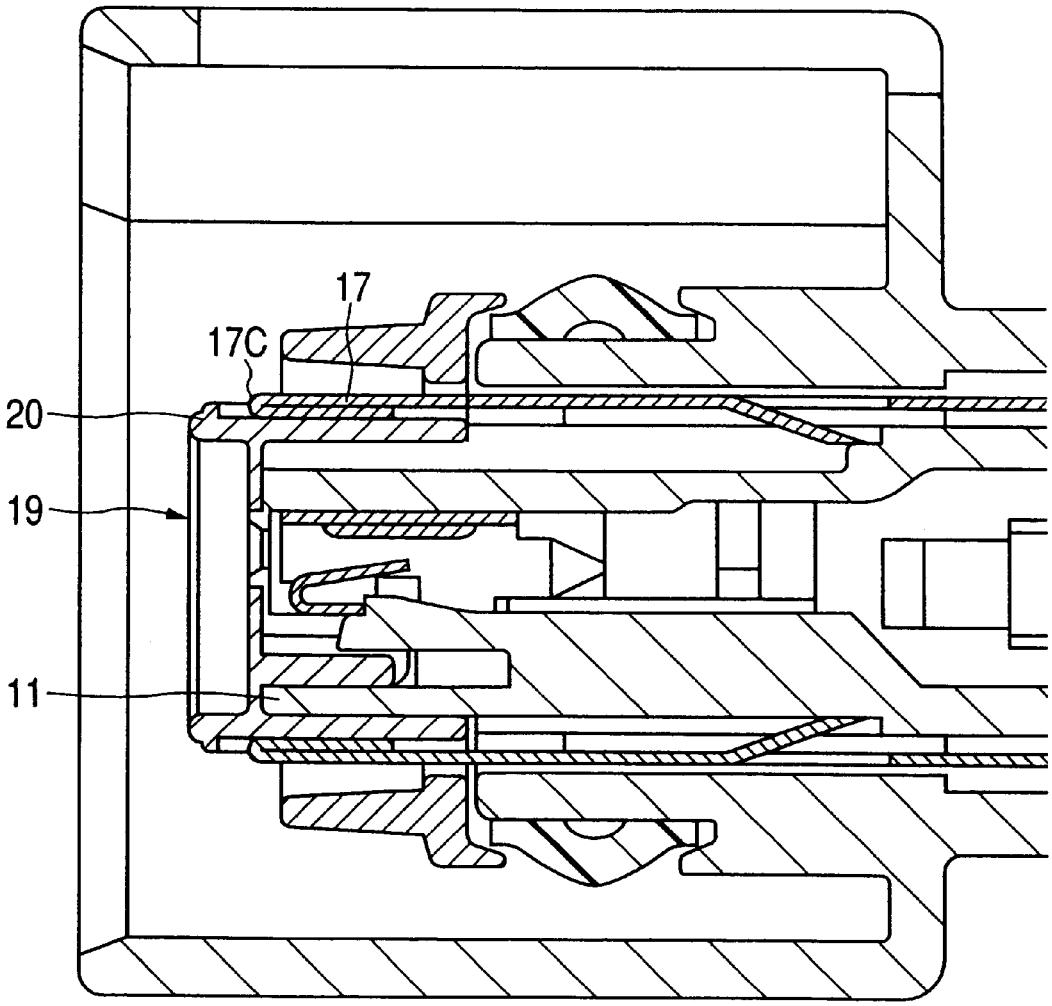
FIG. 5 is a side sectional view showing a tip portion of a shield of a third embodiment.
Figure 6:
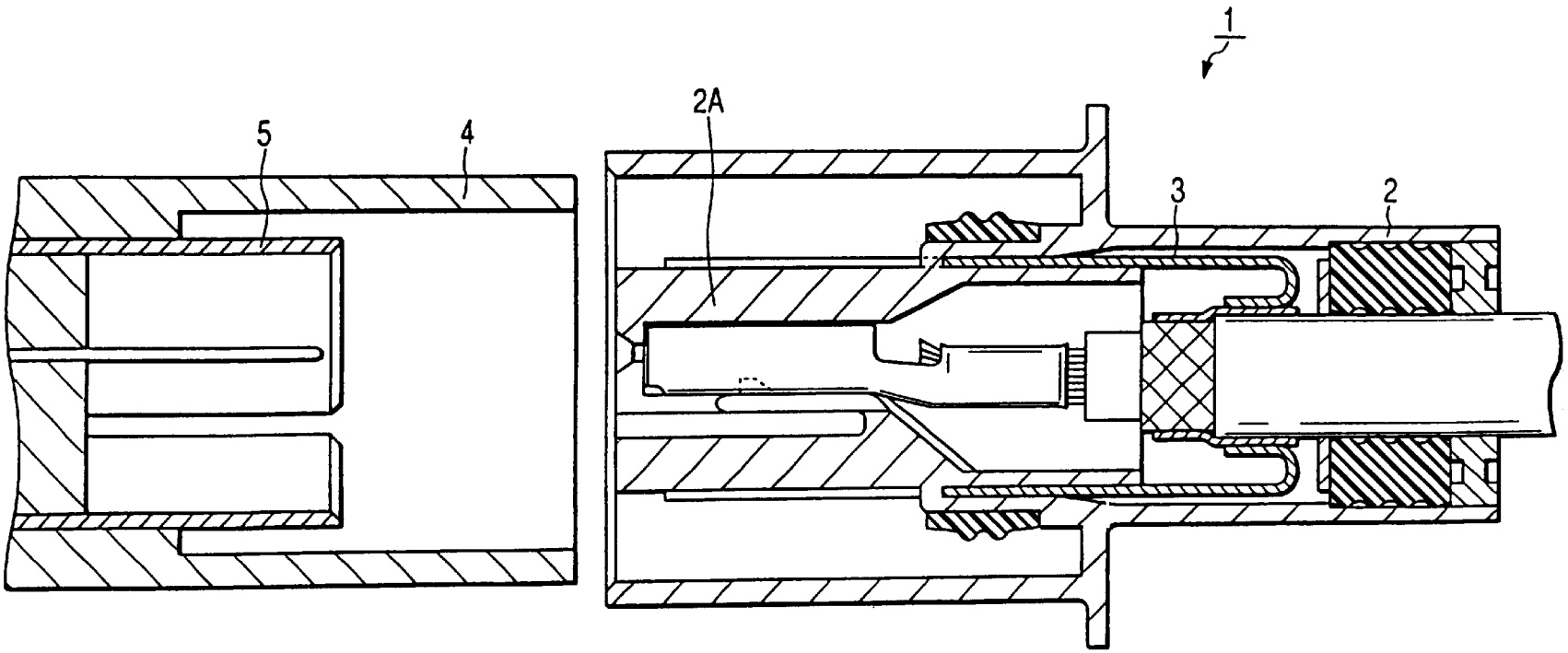
FIG. 6 PRIOR ART
FIG. 6 is a side sectional view showing conventional female and male connectors in a separated state.
Figure 7:
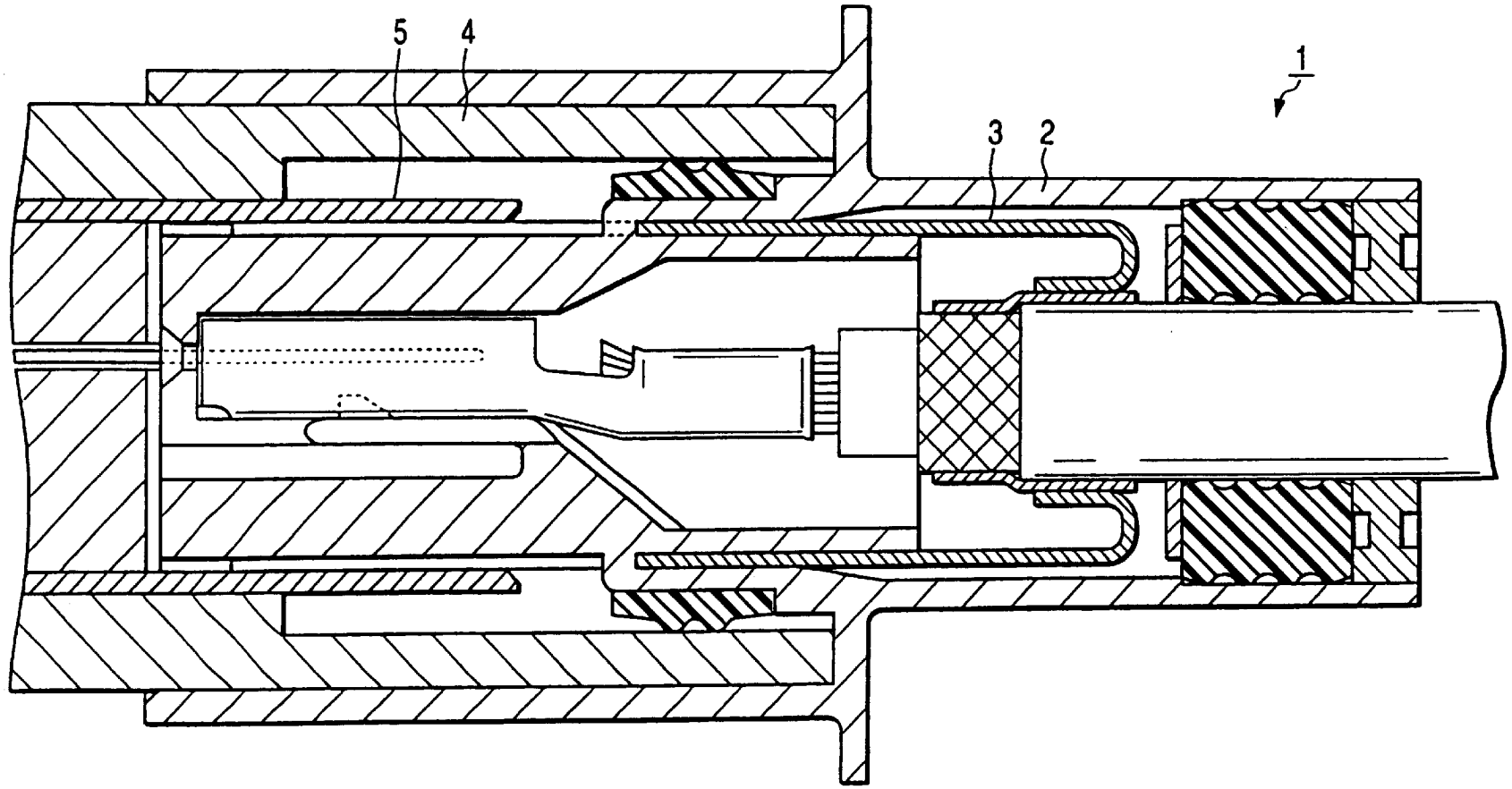
FIG. 7 PRIOR ART
FIG. 7 is a side sectional view of a fitted state of both connectors of the same.
Figure 8:
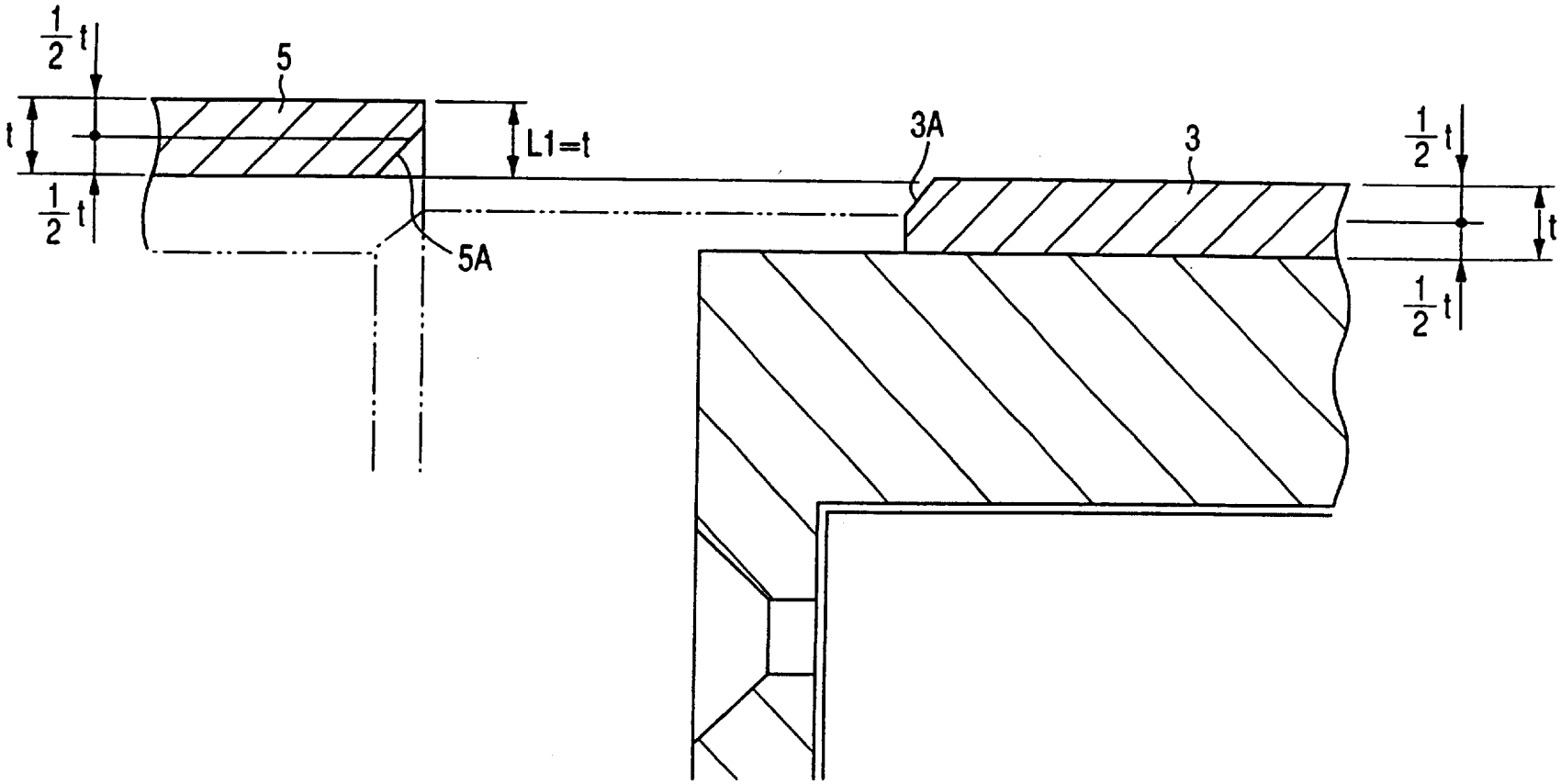
FIG. 8 PRIOR ART
FIG. 8 is a side sectional view showing tip portions of shield shells provided in both connectors of the same.

As shown in FIG. 5, a tip of the female side shield shell 17 of this embodiment is doubled by being folded to an inner peripheral side similarly to the second embodiment, and such a constitution is adopted so that the guide protrusion portion 20 covering the portion folded to the inner side is formed integrally with a double engaging retainer 19 of the female type terminal metal fitting 9 mounted on the female side connector housing 13.

According to this embodiment, since the guide protrusion portion 20 is formed integrally with retainer 19, molds therefor are prevented from becoming complex in comparison with a case where the guide protrusion portion 20 is formed in the female side connector housing 13, and a corresponding increase in the manufacturing cost can be prevented.

In this embodiment, although a gap is provided between a tip face of the female side shield shell 17 and the guide protrusion portion 20, a shield connector of such a constitution is also contained in the technical scope of the invention.

Other Embodiments

The invention is not limited to the above description and drawings, and for example the following embodiments are also contained in the technical scope of the invention and, further, besides the followings various modifications can be performed within a scope not departing from the scope or spirit of the present invention.

(1) The guide protrusion portion of the invention may be either of a constitution in which it entirely covers a front end face of the shield shell over a peripheral direction or a constitution in which it covers partially.

(2) Although in the first embodiment the taper faces 17B and 34B are provided in the front end faces of both shield shells 17 and 34, there may be adopted a constitution in which the taper face is formed only on a tip face of either of the shield shells.

What is claimed is:

1. A shield connector comprising:

a connector housing having an engagement mechanism for engaging with a terminal metal fitting;

a shield shell provided in said connector housing so as to surround the terminal metal fitting, said connector housing fitting with a mating connector housing to thereby cause a mating shield shell provided in said mating connector housing to fit with a tip outer side of said shield shell, thereby making both into an electrically connected state; and a cylindrical hood surrounding said shield shell with an air gap in between and terminating in a direction of an engagement end of said terminal metal fitting;

a tapered guide protrusion portion for guiding a tip of the mating shield shell so as to be fitted to said shield shell by extending from a distal edge of an inner portion to a side of said shield shell of said connector housing;

a retainer;

said tapered guide protrusion portion covers a lower half of a cross sectional side view wall thickness of a leading face of said shield shell and is integrally formed in a retainer, said retainer having a tongue piece forming a double engagement with a tab portion at the terminal metal fitting mounted on said connector housing.

2. The shield connector as set forth in claim 1, wherein said tapered guide protrusion portion is formed so as to cover and precede an inner edge side of a distal end face of said shield shell, in a direction of connection and at a distal leading end of said tapered guide protrusion portion there is formed an inclined face inclining so as to proceed to an outer side of said shield shell as going toward an inner part of the fitting.

* * * * *